United States Patent [19]

Malbec et al.

[11] Patent Number: 4,500,760

[45] Date of Patent: Feb. 19, 1985

[54] THERMOSTAT-CONTROLLED ELECTRIC SWITCH

[75] Inventors: Yves Malbec; Yves Boisot; Daniel Bontemps; Georges Duhamel, all of Paris, France

[73] Assignee: Thomson-CSF, France

[21] Appl. No.: 420,839

[22] Filed: Sep. 21, 1982

[30] Foreign Application Priority Data

Sep. 29, 1981 [FR] France ..... 81 18348

[51] Int. Cl.[3] ..... H01H 35/24

[52] U.S. Cl. ..... 200/83 C; 200/83 Z

[58] Field of Search ..... 200/83 C, 83 Z, 83 S, 200/83 SA; 337/116, 117

[56] References Cited

U.S. PATENT DOCUMENTS 4,082,929 4/1978 Thorsen ..... 200/83 C 4,274,546 6/1981 Branson et al. ..... 200/83 C X

FOREIGN PATENT DOCUMENTS 1566596 5/1969 France .

*Primary Examiner*—J. R. Scott

*Attorney, Agent, or Firm*—Cushman, Darby & Cushman

[57] ABSTRACT

A thermostatic switch with a pair of switch contacts opened and closed by a first pivotably mounted lever urged in one direction by a spring and in the other by a bellows to alternately open and close the switch to operate a compressor. A manual switch can be rotated to vary the spring force through a cam follower and is also movable in and out of the housing. When moved into the housing a second lever is pivoted to engage the first lever and the cam follower so the force required by the bellows to pivot the first lever is such that defrosting occurs.

5 Claims, 7 Drawing Figures

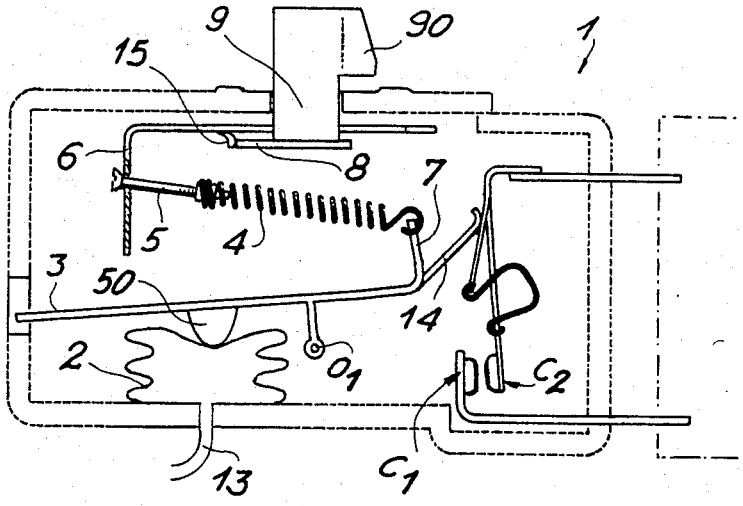
FIG. 1 (PRIOR ART)
FIG. 2 (PRIOR ART)
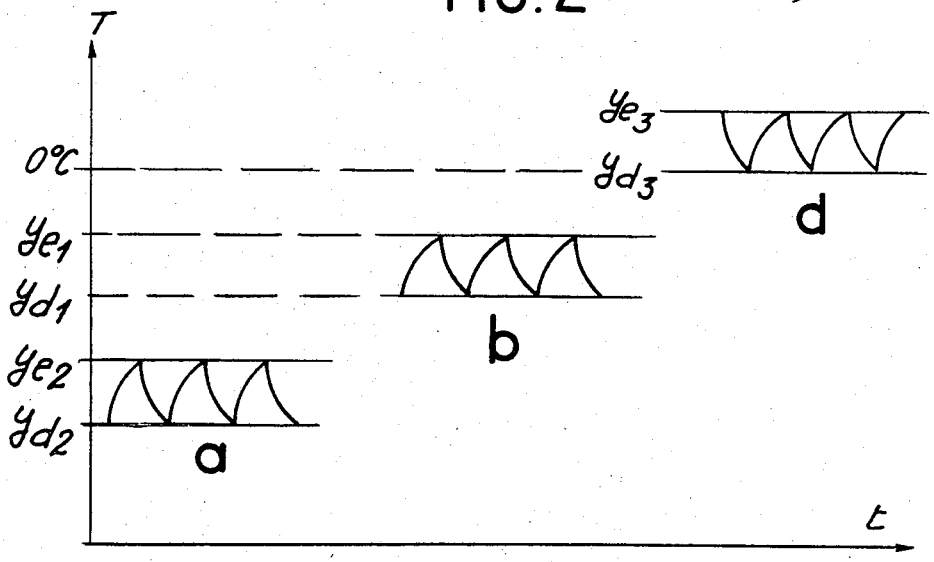

THERMOSTAT-CONTROLLED ELECTRIC SWITCH

BACKGROUND OF THE INVENTION

This invention concerns a thermostat-controlled electric switch for a refrigerator chamber with semi-automatic defrosting.

With thermostats of the prior art, such a switch normally regulates the temperature of a refrigerated chamber by keeping the temperature of the evaporator in the cold-generating system within two predetermined limits $T_1$ and $T_2$.

These upper and lower limits, normally below zero Centigrade, can be slightly altered by the user of the refrigerator turning a handle in the desired direction. The difference $\Delta T$ between the two selected temperatures remains fixed. Consequently, defrosting can be carried out if at least one of the two limit temperatures is above zero degrees Centrigrade, for a selected position of the handle. This means that the handle has to be turned manually to the defrosting position, then back to its original setting when defrosting is completed.

The switch according to this invention allows one, by pressing on a push-button, to raise the temperature for which the compressor unit of the refrigerator comes into operation, to a temperature $T_D$ (defrosting temperature) above 0° C., during a single operating cycle, the length of which depends on the average working temperature selected for the refrigerator. Return to normal functioning and resetting of the control button are automatic.

SUMMARY OF THE INVENTION

This invention concerns a thermostatic switch, comprising a bellows device containing an expandable fluid and provided with a hermetic tube acting as a thermometer; a lever which can pivot on a fixed axis, and which is designed to combine with the bellows device to control operation of the switch; and means of applying to this lever a force to make it pivot on its axis and to keep it temporarily in a position corresponding to the open position of the switch, the return to its normal position corresponding to the closed position of the switch occuring abruptly, as a result of the thrust exerted by the bellows device when this reaches a predetermined value; a second lever which can pivot on a fixed axis, and which is designed to press temporarily on the first lever in order to make it pivot on its axis, thereby opening the switch contacts; and means of applying to this second lever a predetermined force to keep it temporarily pressed against the first lever.

BRIEF DESCRIPTION OF THE DRAWINGS

Further features and advantages of the invention will appear from the following description, with reference to the accompanying figures:

FIG. 1, showing a diagrammatical view of a thermostatic switch in the prior art;

FIG. 2, showing temperature-variation curves corresponding to operating cycles of the compressor to which the switch in FIG. 1 is fitted, for three selected average temperatures;

DESCRIPTION OF THE PREFERRED EMBODIMENTS

Figure 3:
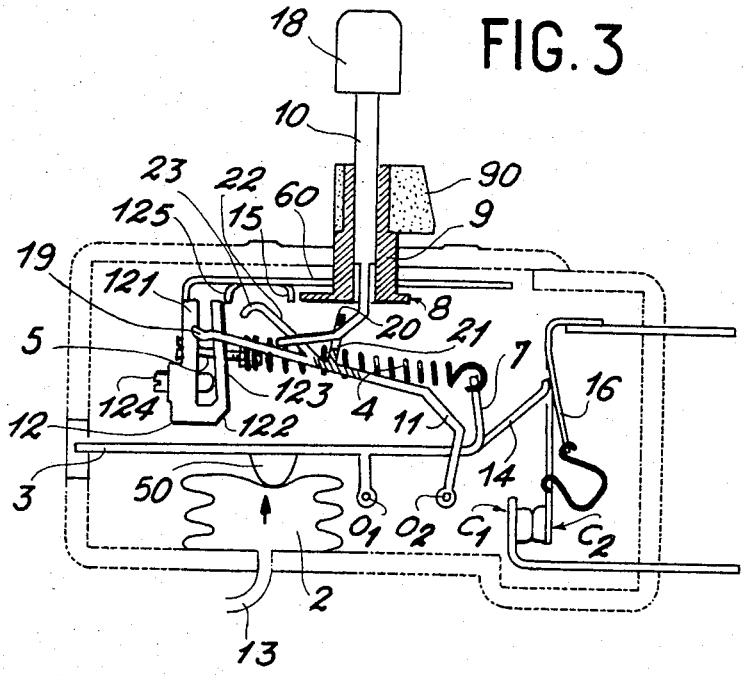
FIGS. 3 and 4, showing diagrammatical views of an embodiment of this new thermostatic switch, in two different operating positions.

FIG. 1 shows a switch 1 used to control a compressor at a refrigerator, for example, comprising a fixed contact $C_1$ and a mobile contact $C_2$, and a bellows device 2, provided with a hermetic tube 13 acting as a thermometer. This device contains an expandable fluid, and it varies in volume depending on the temperature in the refrigerator. It is accompanied by a lever 3, which can pivot on a fixed axis $O_1$, and one end of which forms a yoke, comprising a metal lug 7 integral with the lever and attached to a return spring 4, the tension of which can be adjusted by means of a screw 5, and a pin 14 made of insulating material, designed to operate the mobile contact $C_2$ of the switch 1.

A temperature-control handle 90 is fixed to the shaft 9 of a cam 8, combined with a cam follower 6 provided with a catch 15.

The thermostat in FIG. 1 is shown in the disengaged position, with both contacts $C_1$ and $C_2$ open.

When in this desengaged position, the thermostat prevents any cold from being produced in the refrigerator. The temperature in the chamber thereupon rises, and the fluid inside the bellows device 2 expands, increasing the volume of the device, which presses against a hump 50 on a the lever 3, moving it gradually until it reaches a position in which the switch contacts $C_1$ and $C_2$ suddenly press against each other. The thermostat is then in the engaged position, and the cold-generating system, such as a compressor, starts up. The temperature in the chamber thereupon drops, the fluid inside the bellows device contracts, the bellows device decreases correspondingly in volume, and the lever 3, drawn back by the spring 4, returns to its starting position. The defrosting cycle is completed.

In a refrigerator using this type of thermostat, temperature control is obtained mainly by keeping temperature variation of the evaporator in the cold-generating device within two predetermined levels ($Y_{d1}$, $Y_{e1}$) ($Y_{d2}$, $Y_{e2}$) and ($Y_{d3}$, $Y_{e3}$), as shown in curves a, b and d in FIG. 2. Curves b and a show two different examples of operation with time of the cold generator ("normal" and "colder"), for which the two end set-points are different. Curve d shows temperature variations when the handle 90 is set to defrosting (i.e. with the temperature above 0° C.). With a thermostatic switch of this existing type, defrosting is thus completely manual.

The tension of the spring 4 is adjusted by the screw 5, so that the closing moment of the switch 1 is attained when the temperature in the refrigerator has reached a given level.

When the shaft 9 is rotated by means of the handle 90, this affects the position of the cam 8 and cam follower 6, in contact with the cam by means of the catch 15, and the spring is stretched or released accordingly.

FIG. 3 shows one embodiment of the switch proposed in this invention comprising, as in the prior art, a quick-breaking contactor provided with a fixed contact $C_1$, and a mobile contact $C_2$, a bellows device 2 containing a fluid affected by temperature variations inside the refrigerated chamber and having a hermetic tube 13, a lever 3 with a swell 50, and one end in the shape of a yoke formed of a metal lug 7 attached to a return spring 4, and a pin 14 made of insulating material, to operate the mobile contact $C_2$.

This thermostat further comprises a push-button 18 attached to a push-rod 10 passing axially through the shaft 9, and the unattached end of which is curved, and a second "defrosting" lever 11, which can pivot on a fixed axis $O_2$.

This second lever 11 is fitted at one end with a pin 19 and, at a given distance from the pin, a bar 20 containing an aperture 21 through which the curved part of the push-rod passes, and also a projecting arm 22, the free end of which is rounded to a semicylindrical tip.

An approximately U-shaped component 12, made from a material with a certain amount of springiness, comprises one prong 121 integral with the cam follower 60, and a flat elastic prong 123, the base of which has a bevelled face 122, and the angle of which can be altered by means of a screw 124.

The cam follower 60 is provided with a catch 15, which presses against the cam 8, and with another catch 125, the function of which is to limit movement of the elastic prong 123.

When the push-rod 10 is in the raised position, the thermostat performs its cycles normally, to keep the right temperature inside the refrigerator. FIG. 3 shows the contacts $C_1$ and $C_2$ pressed against each other, indicating that the cold-generating device system is in operation.

When the user wishes to defrost the refrigerator, he simply presses the push-button 18, thereby pushing in the push-rod 10, which presses back the defrosting lever 11, in a pivotal movement on its axis $O_2$.

Figure 4:
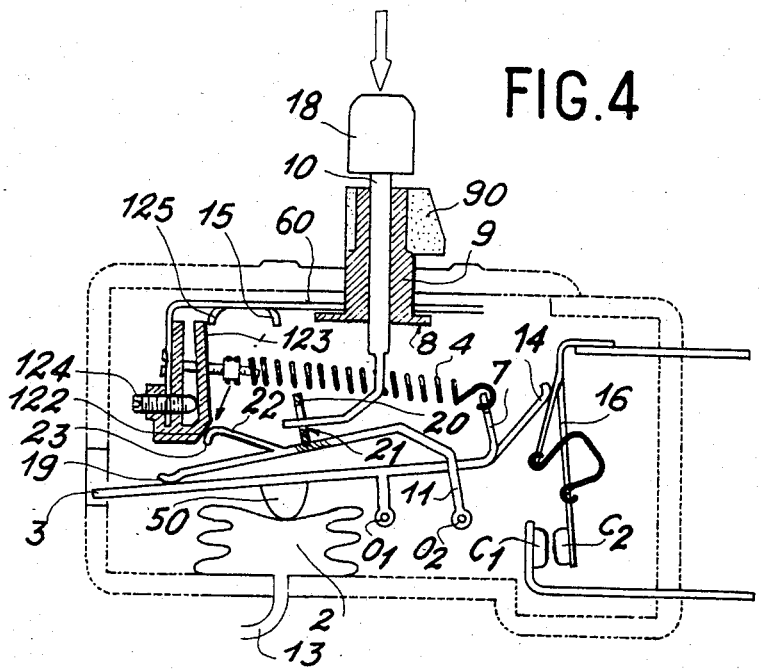

During this movement, the semicylindrical tip 23 comes into contact with the flat part of the elastic prong 123 of the U-shaped component 12, pushing it back, together with the follower 60 to the position shown in FIG. 4. The catch 15 moves away from the cam 8. The movement of the follower 60 increases tension on the spring 4, which tends to turn the first lever 3. The pin 19 of the defrosting lever 11 also presses against the first lever 3, which pivots on its axis $O_1$, and consequently the end pin 14, causing the switch contacts $C_1$ and $C_2$ to open suddenly.

When the push-rod 10 is pressed down, the tip 23 of the projecting arm 22 moves down the flat prong 123 of the U-shaped component 12, pushing it back and pressing against the bevelled face 122. This blocks the tip 23, and consequently the defrosting lever 11, in this position.

The first lever 3 is thereupon subjected, on the one hand to the restoring force of the spring 4, which has been stretched by the movement of the cam follower 60, as described above, and on the other hand to the pressure of the pin 19 on the defrosting lever 11.

The position of the system is therefore completely independent of the position of the cam 8, and so of the operating temperature settings originally chosen, corresponding to the combined positions of the cam 8, shaft 9 and temperature-control handle 90.

The thermostat re-engages, closing the contacts $C_1$ and $C_2$ automatically.

When the contacts $C_1$ and $C_2$ are open, the cold-generating system, such as a compressor, is switched off. The temperature rises inside the refrigerator, until it reaches the defrosting temperature. The fluid inside the bellows device 2 expands, increasing the volume of the device, so that the side of the device opposite the hump 50 on the first lever 3 pushes back this lever which in turn presses on the defrosting lever 11. When this repelling force reaches a determined level, adjustable by means of the screw 124, the semicylindrical tip 23 moves away from the bevelled face 122 of the U-shaped component 12, and the pin 19 moves away from the first lever 3, which is thereby released and, being subject only to the movement of the bellows device 2 and spring 4, pivots on its axis $O_1$. The pin 14 pushes the bar 16 carrying the mobile contact $C_2$, which presses against the fixed contact $C_1$, switching the compressor on again.

Figure 5:
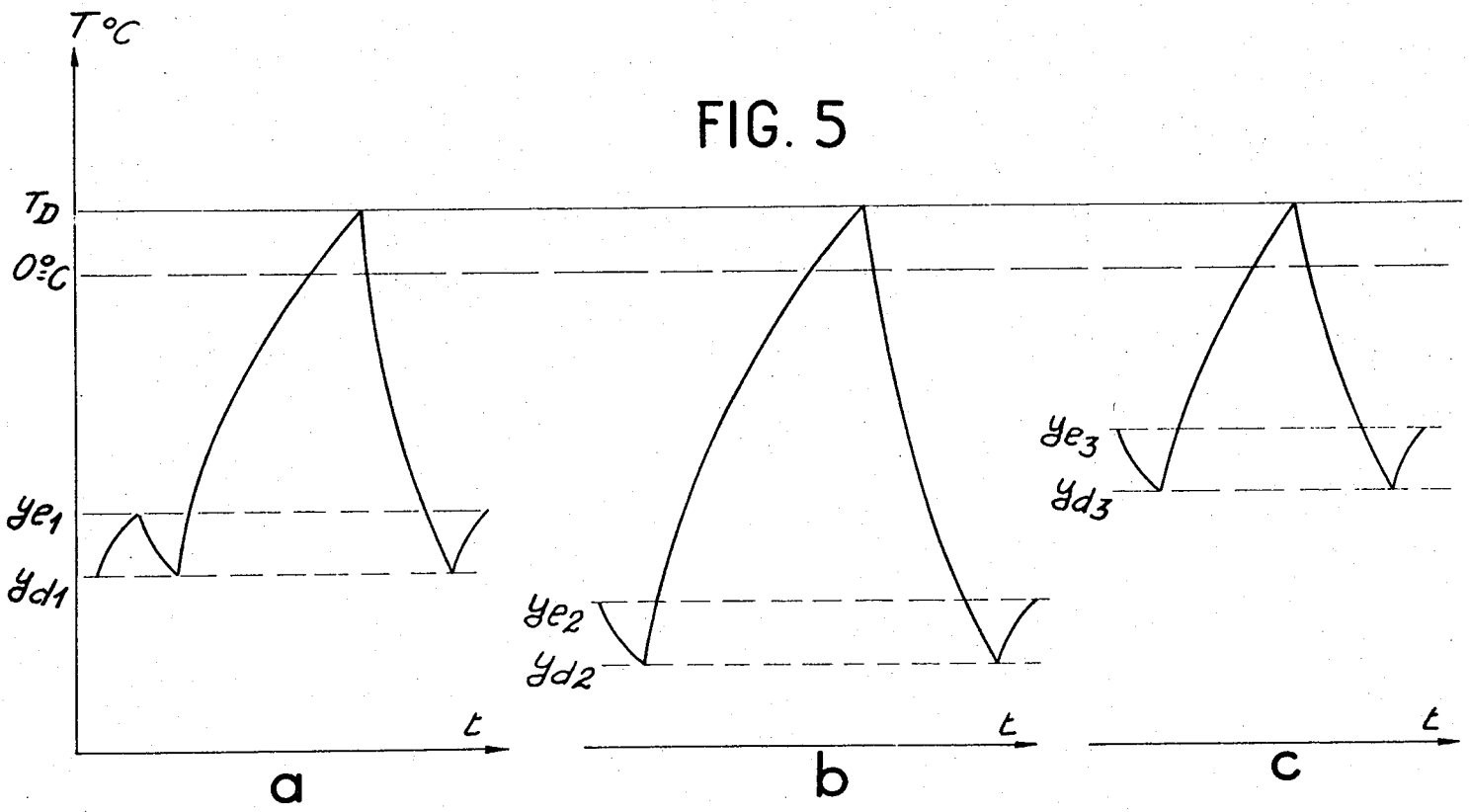
FIG. 5, showing temperature-variation curves for the switch shown in FIGS. 3 and 4, for three selected average temperatures.

FIG. 5 shows three temperature-variation curves, a, b and c, for the refrigerator, in relation to time t, for three different temperature T settings. In each case, the defrosting temperature $T_D$ is the same, even though thermostat engagement temperatures $y_{e1}$, $y_{e2}$, $y_{e3}$, and disengagement temperatures $y_{d1}$, $y_{d2}$, $y_{d3}$, are different. In the example illustrated here, the temperature difference between engagement and disengagement temperatures remains the same, depending on the thermostat setting but the switch could be designed for operation with variable temperature differentials.

The defrosting operation can be interrupted at any time by pulling the push-rod 10.

A resistant element to speed up defrosting can also be included in the thermostat circuit. This is energized automatically when the system goes into the defrosting cycle.

Figure 6:
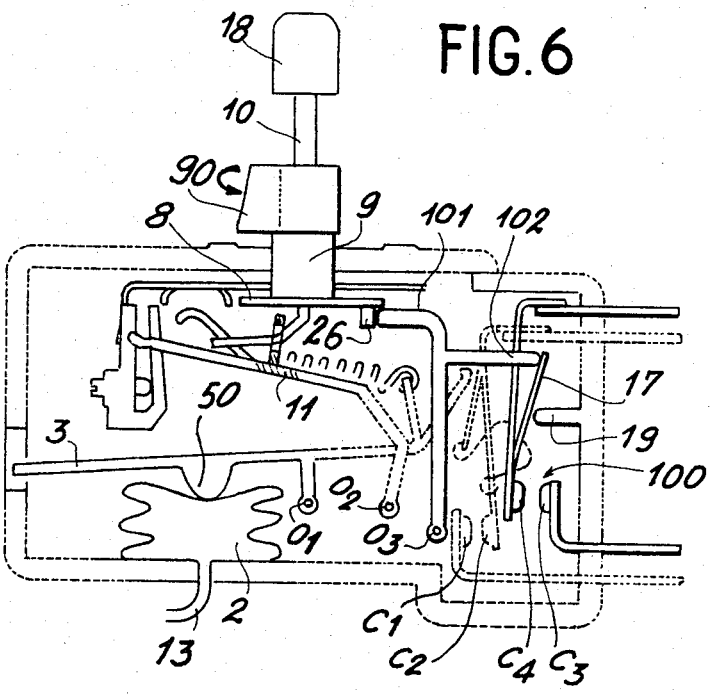
FIG. 6, showing a diagrammatical view of another embodiment of this new thermostatic switch.
Figure 7:
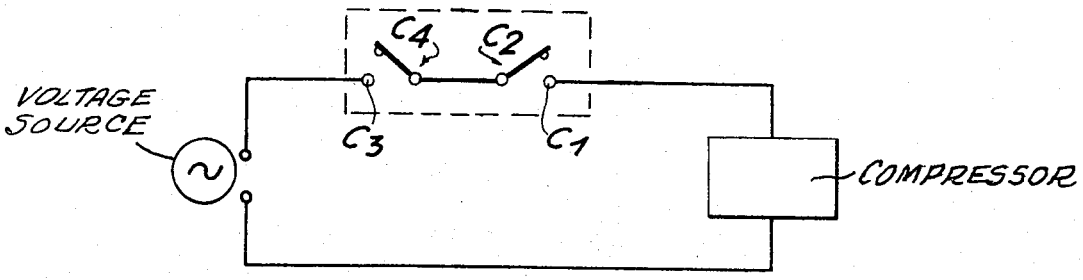
FIG. 7, showing an electrical circuit suitable for use with the switch shown in FIG. 6.

In another embodiment, shown in FIGS. 5 6, and 7, a second contactor 100, comprising a fixed contact $C_3$ and a mobile contact $C_4$, can be included in the circuit. It is controlled by further rotation of the handle 90, and switches off the whole refrigerating system.

In this case the cam 8 comprises a third catch 26 which, when the handle 90 is turned to the "Off" position, comes into contact with a lever 101 which pivots on an axis $O_3$, and which comprises an arm 102. This arm pushes against a matching arm 17 on an elastic strip carrying the mobile contact $C_4$, which thereupon moves away from the fixed contact $C_3$. In the course of this movement, the tongue 17 pivots in the normal way on a pin (not shown here). The cold-generating system is switched off as power is interrupted between the voltage source and compressor $C_R$. These contacts $C_1$, $C_2$, $C_3$ and $C_4$ can be placed in the circuit of a compressor $C_R$, as shown in FIG. 7.

The thermostatic switch as proposed in this invention is suitable for use in refrigerators with semi-automatic defrosting, but also for any cyclic control systems employing temperature or pressure variations.

More generally, this switch can be used to create an exceptional variation in the working temperature or pressure of an appliance.

What is claimed is:

1. A thermostatic switch for a refrigerator comprising:

a housing;

a pair of switch contacts within said housing and movable between an open and closed position for causing operation of a compressor in a first position to cool said refrigerator and interrupting operation in a second position to permit said refrigerator to warm;

a first lever pivotably mounted within said housing engaging said switch contacts for moving said contacts between said positions;

a bellows engaging said first lever and containing an expandable fluid and provided with a hermetic tube acting as a thermometer for producing a force urging said first lever to pivot in a first direction so as to move said switches to said first position as said fluid expands;

a manually operable handle extending into said housing and mounted to be rotatable and movable into and out of said housing between first and second positions;

a cam mounted on said handle for rotation therewith;

a cam follower operatively associated with said cam and displaceable in response to rotation of said cam;

a spring connecting said cam follower to said first lever for urging said first lever to pivot in a direction opposite said first direction, the amount of force applied varying with the position of said cam follower and determining the force required by said bellows to cause said first lever to pivot and move said switch contacts to said first position;

a second lever pivotably mounted within said housing and engaging said handle for pivotable movement in response to movement of said handle from said first position to said second position to engage said first lever and pivot said first lever in said direction opposite said first direction to move said switch contacts to said second position, said second lever also engaging said cam follower when said handle is in said second position so that the force required by said bellows to cause said first lever to pivot and move said switch contacts to said first position is greater when said handle is in said second position and the refrigerator is defrosted when said handle is in said second position.

2. A switch as in claim 1 wherein said cam follower includes a U-shaped elastic component having a bevelled face on one leg, and a screw extending between the legs for adjusting the angle of the bevelled face and said second lever includes a cylindrical tip engaging said face when said handle is in said second position.

3. A switch as in claim 1 wherein said handle includes a push-rod.

4. A switch as in claim 3 wherein said push rod has a curved end in said housing and said lever includes a bar having an aperture through which said curved end passes.

5. A switch as in claim 1 including a second pair of switch contacts and a third lever pivotably mounted in said housing for engaging said cam follower when said cam follower is rotated to a given position to open said second pair of contacts and switch off the refrigerator.

* * * * *